US007762187B2

(12) United States Patent
Petri

(10) Patent No.: US 7,762,187 B2
(45) Date of Patent: Jul. 27, 2010

(54) DEVICE AND METHOD FOR REMOVING THE JACKET FROM CLICHÉ ROLLERS IN PRINTING MACHINES

(75) Inventor: Stefano Petri, Capannori (IT)

(73) Assignee: Futura S.p.A., Badia a Cantignano (LU) (IT)

( * ) Notice: Subject to any disclaimer, the term of this patent is extended or adjusted under 35 U.S.C. 154(b) by 531 days.

(21) Appl. No.: 11/571,776

(22) PCT Filed: Jun. 27, 2005

(86) PCT No.: PCT/IT2005/000368

§ 371 (c)(1),
(2), (4) Date: Jan. 8, 2007

(87) PCT Pub. No.: WO2006/048907

PCT Pub. Date: May 11, 2006

(65) Prior Publication Data

US 2008/0302261 A1 Dec. 11, 2008

(30) Foreign Application Priority Data

Nov. 8, 2004 (IT) ..... FI2004A0226

(51) Int. Cl.
*B41F 27/00* (2006.01)

(52) U.S. Cl. ..... 101/375; 101/477; 101/479

(58) Field of Classification Search ..... 101/375
See application file for complete search history.

(56) References Cited

U.S. PATENT DOCUMENTS

| | | | | |
|---|---|---|---|---|
| 3,043,211 | A * | 7/1962 | Appenzeller | 100/170 |
| 3,146,709 | A * | 9/1964 | Bass et al. | 101/375 |
| 4,823,693 | A * | 4/1989 | Kobler | 101/375 |
| 4,903,597 | A * | 2/1990 | Hoage et al. | 101/375 |
| 5,706,731 | A * | 1/1998 | Francille et al. | 101/375 |
| 6,283,026 | B1 * | 9/2001 | Tocheport et al. | 101/375 |
| 6,526,885 | B2 * | 3/2003 | Walczak et al. | 101/375 |
| 7,290,488 | B2 * | 11/2007 | Petersen et al. | 101/375 |
| 7,392,741 | B2 * | 7/2008 | Maggio | 101/216 |
| 2006/0096478 | A1 * | 5/2006 | Marchini | 101/375 |

FOREIGN PATENT DOCUMENTS

| | | | |
|---|---|---|---|
| DE | 43 03 381 | A1 | 12/1994 |
| EP | 1 110 727 | A1 | 6/2001 |
| GB | 2274812 | A * | 8/1994 |

* cited by examiner

*Primary Examiner*—Jill E Culler
(74) *Attorney, Agent, or Firm*—McGlew and Tuttle, P.C.

(57) ABSTRACT

Device for the substitution of a cliché-jacket from a cliché cylinder in a printing machine or the like wherein said cylinder (1) is connected to a motor (3) driving it into rotation about its longitudinal axis and is provided with radial holes connected with an air inlet (7), the latter being apt to be connected with a compressed air supply (6) by means of a delivery means (8), device characterized in that it comprises automatic means sensing the position of said air inlet (7) relative to said delivery means (8) and automatic means for positioning said air inlet (7) and said delivery means in a reciprocal coupling position, said automatic sensing and positioning means being connected to a programmable electronic unit (E) which, when said air inlet (7) and said delivery means (8) are coaxial, drives said coupling and switches on an on-off valve (60) which, on a side, is connected to said compressed air supply (6) and, on the other side, is connected to said delivery means (8).

14 Claims, 5 Drawing Sheets

DEVICE AND METHOD FOR REMOVING THE JACKET FROM CLICHÉ ROLLERS IN PRINTING MACHINES

The present invention relates to a device and a method for removing the jacket from cliché rollers in printing machines. In particular, even if not exclusively, the present device and method are destined to machines of the type used for making prints on paper webs or plies for the production of kitchen paper rolls, toilette rolls and the like.

It is known that the printing machines of the above-mentioned type, also known as flexographic printing machines, comprise a cylinder onto which the web to be printed is fed, and at least a cliché cylinder, onto which the printing ink is distributed and from which the ink is transferred to the web to be printed. In order to obtain the distribution of the ink onto the cliché cylinder, provision is made for a unit, commonly said "colour group", comprising an ink reservoir, a distributor or "anilox" cylinder receiving the ink from the reservoir and transferring it by contact to the cliché cylinder, and two blades positioned and acting between the ink reservoir and the anilox cylinder. These printing machines may be provided with more colour groups. Said cliché cylinder is constituted by a smooth cylindrical body onto which a removable jacket is fitted, as a sleeve, said jacket being provided with relief apt to define the drawings and writes to be printed. Therefore, to change the prints it is sufficient to remove the jacket from the cliché cylinder and substitute it with a different one. Hereinafter, the said jacket will be also referred to as "cliché-jacket".

The operation described above usually involves all the colour groups of the printing machine. The latter, during the cliché-jacket substitution, must be stopped and it is cause for production loss, this inconvenient being as more evident as higher is the time required to operate said substitution.

In order to substitute the cliché jacket, it is necessary to slightly expand the latter to allow an easier extraction thereof. At this end, the cliché cylinder is provided with an air inlet to which an end of a duct is manually connected, the said duct being connected to an air compressor. The compressed air thus entering the cylinder escapes through a plurality of radial holes provided within the same cylinder, causing the jacket expansion and thus facilitating its extraction, i.e. removal. Once executed the jacket substitution, the compressed air flow is interrupted and, before to restart the machine, it is necessary to disconnect the compressed air feeding duct from the cylinder. These operations are performed with the cylinder being stopped and in a "cantilever" position, i.e. locked in correspondence of its motor side end, the transmission side end of the cylinder being free to allow the extraction and subsequent remounting of the cliché jackets by moving them along the cylinder axis, starting from the operator side of the latter. Since the operator first has to connect the compressed air duct and then remember to disconnect it before to re-start the machine, may be cause for injuries to the operator and damages to the machine. In fact if said duct is not disconnected after having substituted the cliché-jacket and before to re-start the machine, the duct, the cylinder and other parts of the machine may be subject to breaking and the respective fragments may provoke injuries to the operator.

The main aim of the present invention is to avoid the above mentioned drawbacks.

This result has been achieved, according to the present invention, by adopting the idea to realize a device and a method having the characteristics described in the independent claims. Further characteristics of the present invention are the object of the dependent claims.

Thanks to the present invention, it is possible to highly increase the job safety and highly reduce the risk of damages for the machine. Furthermore, the present invention makes it possible to reduce the time required to substitute the cliché-jacket and, consequently, to reduce production losses, this being even more evident if one considers the high number of distributor groups normally involved. Furthermore, a device according to the present invention is relatively easy to make, is safe and easy to operate, and it is reliable even after a prolonged service time.

Examples of the present invention will now be described in detail with reference to the accompanying drawings, in which:

FIG. 1 is a schematic longitudinal section view of a cliché cylinder provided with a device according to a possible embodiment of the present invention shown in an operative state;

FIG. 2 refers to the example shown in FIG. 1 with the cliché cylinder in an inoperative state, that is, positioned in such a manner to allow the substitution of the cliché jacket;

Figure 1:
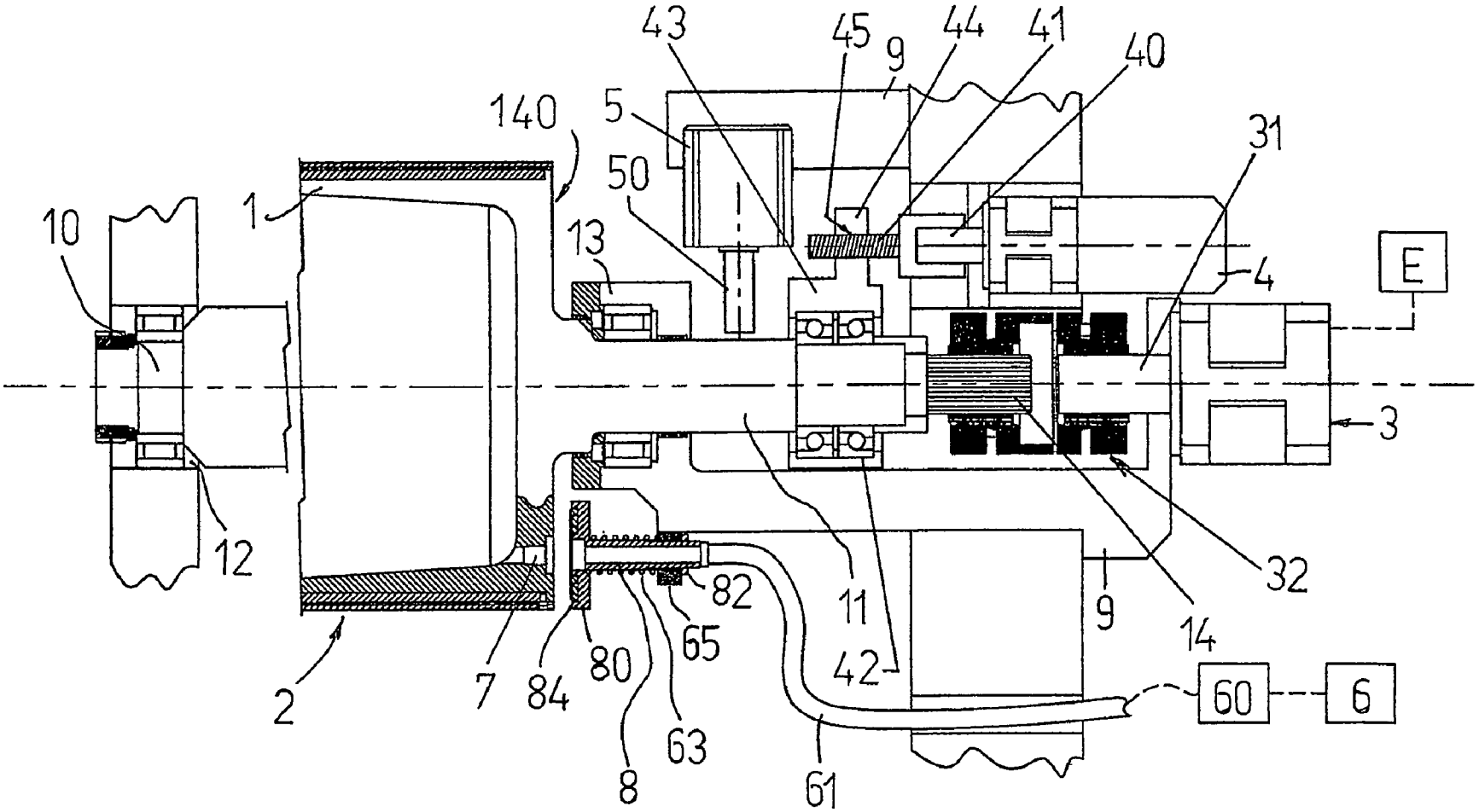

Although the present invention will be described with reference to the embodiments shown in the drawings, it should be understood that the present invention can be embodied in many alternate forms of embodiments.

Generally speaking, a device according to the present invention can be used for the removal of a jacket from a cliché cylinder in a printing machine or similar. In this type of machine, said cylinder is motorized to drive it into rotation about its own longitudinal axis, and is provided with an inlet connectable, on one side, to a compressed air supply and, on the other side, to a plurality of radial holes crossing the cylinder and utilizable to obtain a deformation of the jacket fitted on the cylinder. The device according to the invention comprises: means for automatically connecting said inlet to a delivery means connected to said compressed air supply; and means for sensing the position of said inlet relative to said delivery means apt to allow their precise and automatic positioning in a reciprocal coupling position.

In the enclosed drawings, the cliché cylinder is designated by the reference numeral 1, the cliché jacket is designated by the reference numeral 2 and the frame (fixed structure) of the machine is designated by the reference numeral 9. Furthermore, in the following description the wording "operator side" means the side of the machine from which an operator can extract the cliché jacket from a corresponding cylinder and substitute it with another cliché jacket, while "transmission side" means the side of the machine opposed to the operator side, that is, the side of the machine in correspondence of which are positioned the motors driving the rotation of the cylinder cylinders and eventually driving the rotation of further cylinders not shown in the drawings. A cliché cylinder is, as said before, a cylindrical body whose surface is smooth or substantially smooth, onto which a tubular jacket provided with relief is fitted. Said tubular jacket is referred to as "cliché jacket" (independently by the fact that the substance to be distributed be ink or other). The cliché cylinder is provided with an air inlet which is connected, in a per se known manner, to a plurality of radial holes provided within the cylinder: compressed air entering said cylinder through said air inlet flows through said radial holes from the inside to the outside of the cylinder.

Figure 2:
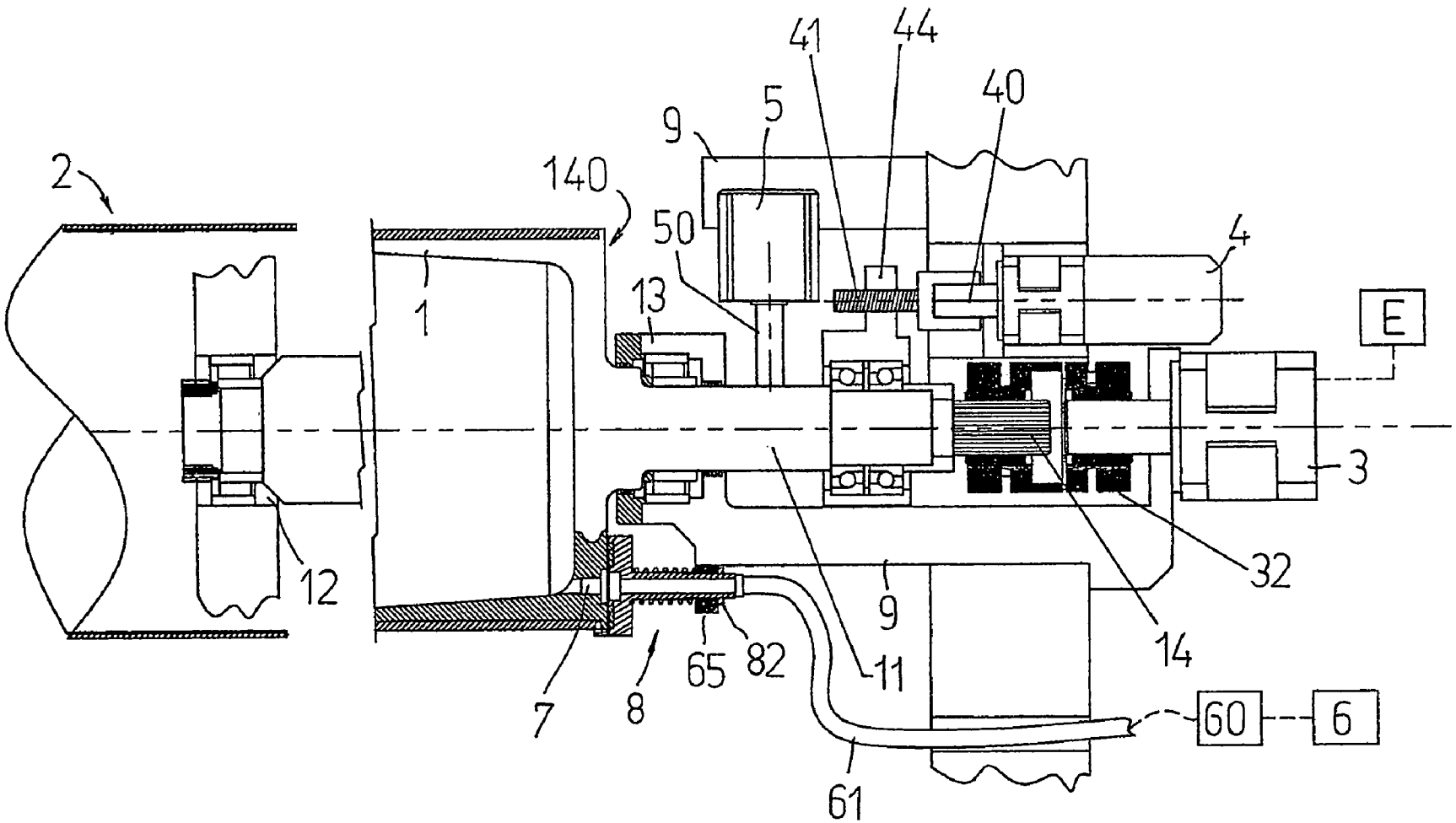

Referring to FIGS. 1 and 2, the cliché cylinder 1 is connected to a corresponding electric motor 3 which drives the cylinder into rotation about the respective longitudinal axis. The cliché cylinder 1 is of the type constituted by a cylindrical body having a smooth or substantially smooth surface, onto which a cliché jacket is fitted. The cliché cylinder 1 is provided with a shaft whose ends 10 and 11 develop towards the operator side and respectively the transmission side of the machine. The ends 10 and 11 of said cylinder are respectively supported by an operator side support 12 and a transmission side support 13. The support 12 and the support 13 are provided with respective roller bearings, of a known type, that is of the type wherein the external ring can axially move with respect to the internal ring.

A terminal portion 14 of said end 11 is shaped as a toothed shaft, so that it realizes a portion of the cylinder 1 cinematically connected to the motor 3 through the respective shaft 31 and a corresponding grooved joint 32. In practice, according to a per se known mechanical scheme, said portion 14 receives the motion from the shaft 31 of the motor 3 and is allowed to longitudinally slide within the joint 32.

A sleeve 42 solid to the shaft of the cylinder 1 is provided, onto a middle portion of the said end 11, in a position between said terminal portion 14 and the portion resulting inside the support 13. Said sleeve 42 is internally provided with a bearing 43 through which a corresponding portion of the cylinder 1 shaft passes. Furthermore, an upper portion 44 of the sleeve 42 is provided with a threading 45.

The frame 9 of the machine also supports a second electric motor 4 whose output shaft 40 is solid to an element provided with a threaded rod 41 engaging the threading 45 of said sleeve 42. In practice, said element, with the relevant threaded rod 41, constitutes an axial prolongation of said shaft 40. The operation of the motor 4 determines the rotation of its output shaft 40 and, consequently, the screwing or unscrewing (depending on the rotation direction) of the threaded rod 41 within the threading 45 of the sleeve 42. Said screwing or unscrewing are cause for the axial movement of the sleeve 42 and of the shaft to which it is solid, i.e. the translation of the cylinder 1 relative to the frame 9 of the machine, with contemporary sliding of the above-mentioned toothed shaft within the joint 32.

The frame 9 of the machine is also provided with a device apt to perform a "cantilever" locking, to be used to lock the shaft of the cylinder 1 during the extraction and the substitution of the cliché-jacket 2 as better described below.

To obtain said cantilever locking of the cylinder 1, it can be used, for example, an actuator 5 supported by the frame 9 on the transmission side of the machine and whose stem 50 is oriented radial with respect to the shaft to be locked, in such a manner to lock said shaft when the actuator 5 is activated. When the stem 50 of the actuator 5 is extracted, the shaft of the cylinder 1 is locked on the transmission side, so that the cliché-jacket 2 can be extracted from the opposed side, i.e. from the operator side, after having removed or disassembled the support 12. During operation, i.e. during printing, the said stem 50 is retracted and the shaft of the cylinder 1 bears on both the respective supports 12 and 13, free to rotate about its longitudinal axis, the rotation being driven by the motor 3.

In the drawings, the block 6 denotes a compressed air supply, which is connected to a supply duct 61, the latter being provided with an electric on-off type valve 60. When the valve 60 is on, the compressed air flows through the duct 61.

The duct 61 is connected to the delivery means 8 which, in the example shown in the drawings, is a tubular body whose distal end 80 is shaped as a disc orthogonal to the longitudinal axis of the delivery means 8. The inner side, i.e. the side facing the cylinder 1, of said disc-shaped end 80 is provided with one or more seal rings 84, for example rubber rings. The tubular body 8 is supported by the frame 9 of the machine and is positioned in a sleeve 62 which, in turn, is fixed to a support 65 solid to the frame 9. A spring 63 is positioned between said disc-shaped end 80 and said support 65, the said spring being intended to keep the disc-shaped end 80 spaced from the support 65. A ring-shaped stop 82 is provided on the tubular body of the delivery means 8, said stop being positioned on opposite side of the spring 63 with respect to the sleeve 62.

The sleeve 62, the delivery means 8 and the spring 63 are coaxial to each other and their common axis is parallel to the rotational axis of the cylinder 1.

The cylinder 1 is provided, in correspondence of its transmission side base 140, with an air inlet 7. The longitudinal axis of said air inlet 7 and said body 8 are equidistant from the rotational axis of the cylinder 1.

When the cliché-jacket 2 is to be substituted, the cylinder 1 is automatically positioned in a position where the air inlet 7 and the delivery means 8 are coaxial, then the cylinder 1 is translated towards the transmission side and, subsequently, the device 5, 50 is activated the lock the cylinder 1 in the cantilever position. The above steps are automatically performed, according to the procedure whose steps are further described below, on command given by the operator.

As said before, means are provide to sense the position of said air inlet 7 relative to the delivery means 8. For example, said means may comprise an encoder or the like connected to shaft of the cylinder 1 or to any element cinematically connected to this shaft. In practice, reference being made to the example shown in the drawings, since the angular position of the delivery means 8 with respect to the longitudinal/rotational axis of the cylinder 1 is known, the support of the delivery means being solid to the frame of the machine, it is sufficient to sense the angular position of the air inlet 7 only. To obtain the coaxial positioning of the said air inlet 7 relative to the delivery means 8, the cylinder 1 is rotated by the motor 3 until the angular positions of the air inlet 7 and the delivery means 8 are coincident (air inlet 7 and delivery means 8 coaxial). To this end, the motor 3 is connected to a programmable electronic unit E, shown in form of a rectangular box in the drawings, which, in turn, is connected to said sensing means from which it receives signals corresponding to the angular position of the cylinder 1 and, consequently, of its air inlet 7. The unit E drives the motor 3 until the air inlet of the cylinder and the compressed air delivery means are coaxial. When this operative condition is reached, the unit E stops the motor 3. Then, the unit E activates the motor 4, thus causing a preset translation of the cylinder 1 towards the machine transmission side. This is obtained, as said above, by the screwing the of the rod 41, driven by the motor 4, within the threading 45 of the sleeve 42 which is solid to the shaft of the cylinder 1. The movement of the cylinder 1 (right-side translation in the drawings) determines the contact between the outlet of the delivery means 8 and the air inlet 7. The contact between the air inlet 7 and the delivery means 8 is improved thanks to the spring 63 and the rings 84 provided by the disc-shaped end 80. Since the overall geometry and the dimensions of each element of the system are known, the length of the said translation to which the cylinder 1 is subject is a known and preset length.

Further sensing means are provided, to sense the length of said translation involving the cylinder 1, including an optical or mechanical switch or the like provided in a preset position along the axial path followed by the cylinder, apt to send an electric signal, eventually with a preset late, to said on-off valve 60. The latter is normally off, i.e. is off when the printing machine is operative. Said sensing means, which are connected to said unit E, can sense the position of the sleeve 42, or the position of the delivery means 8, or the position of every other element which is subject to said axial movement.

When the air inlet 7 of the cylinder 1 is in contact with the delivery means 8, the actuator 5 is activated to cylinder 1 in the cantilever position and the on-off valve 60 is switched on. Therefore, compressed air flows along the path defined by the duct 61, the delivery means 8 and the air inlet 7, reaching the radial holes provided within the cylinder, so that the cliché-jacket 2 is expanded and it may be extracted after having removed or disassembled the operator side support 12.

Figure 3:
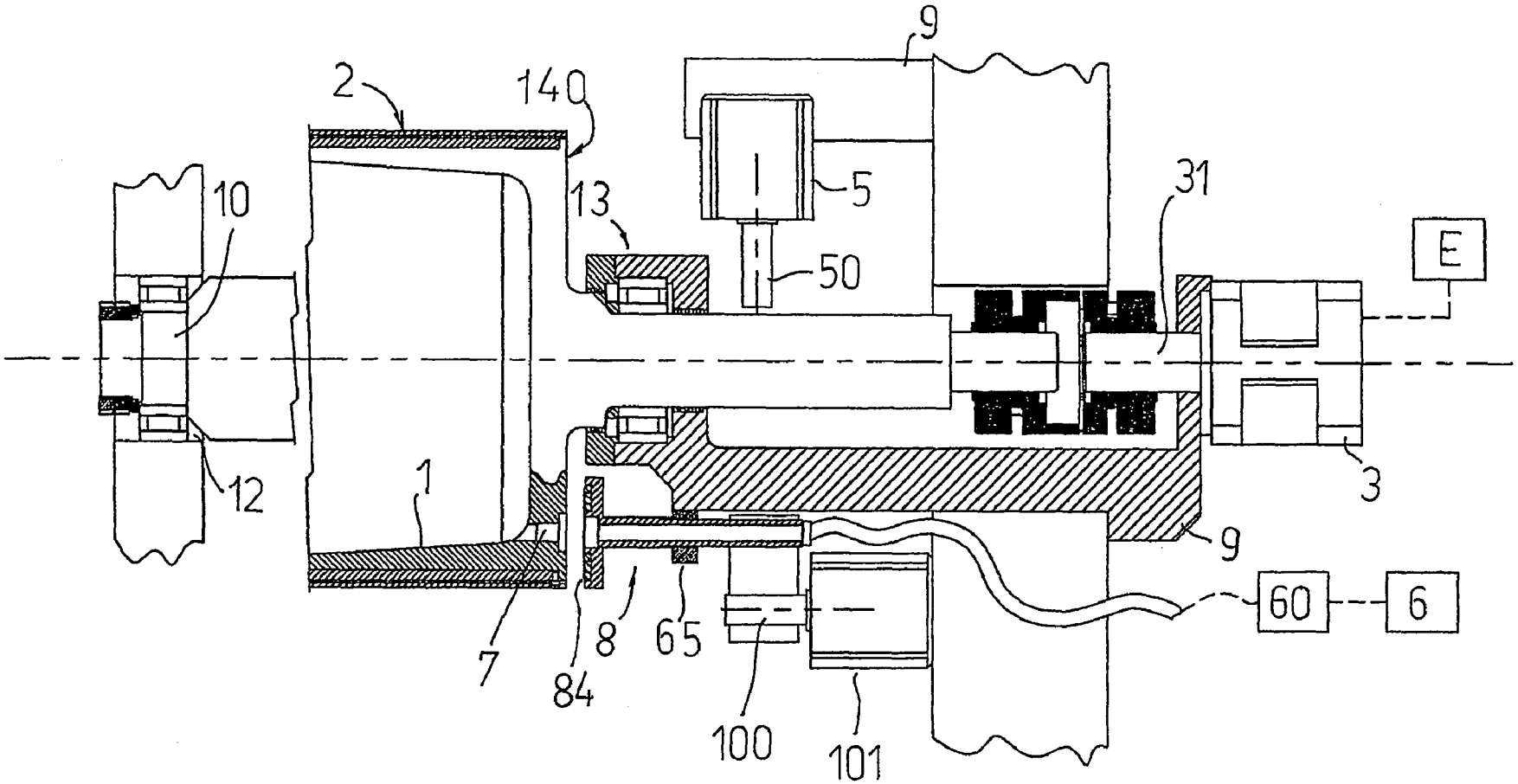
FIGS. 3 and 4 show, as in FIGS. 1 and 2, a device according to a further embodiment of the present invention.
Figure 4:
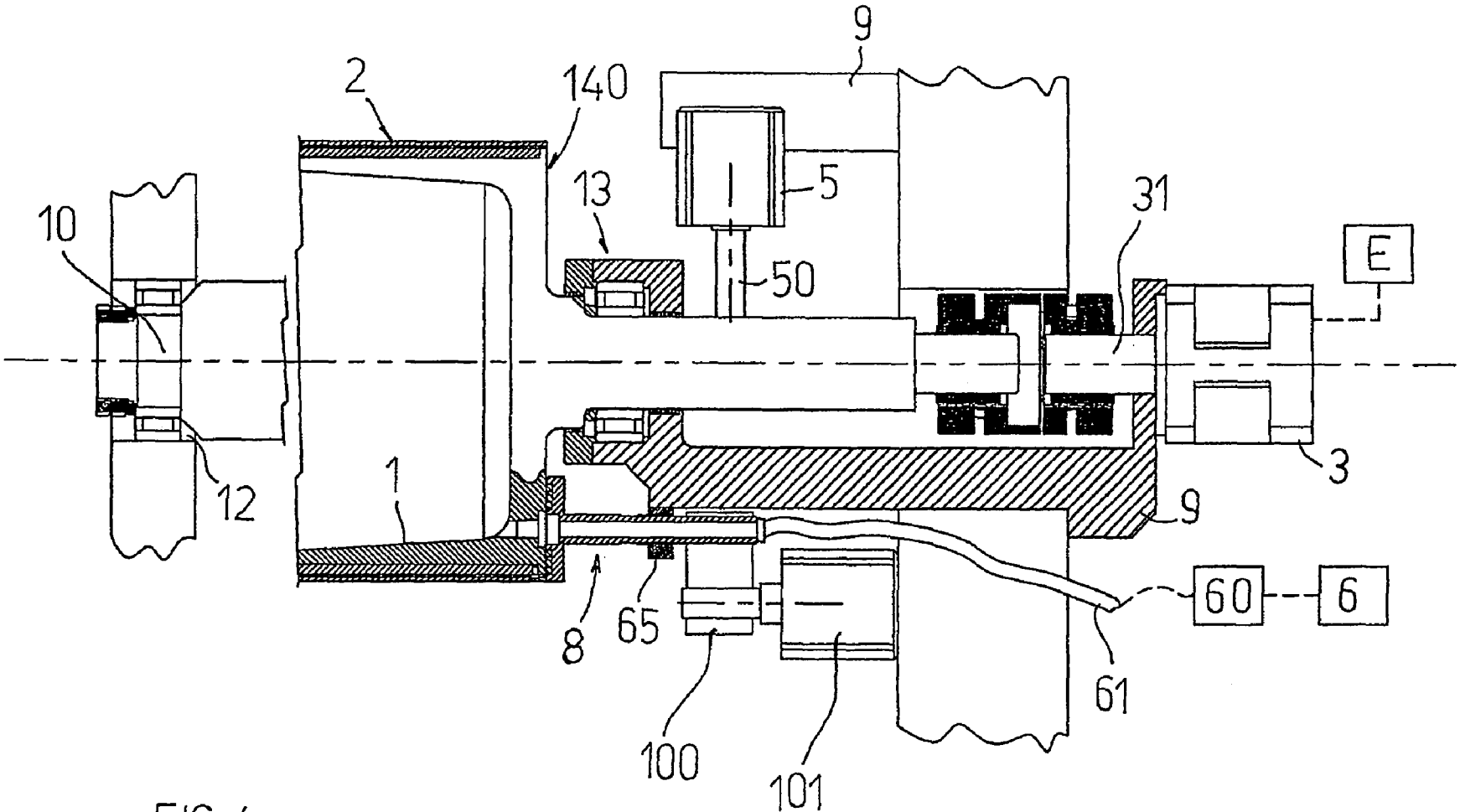
Figure 5:
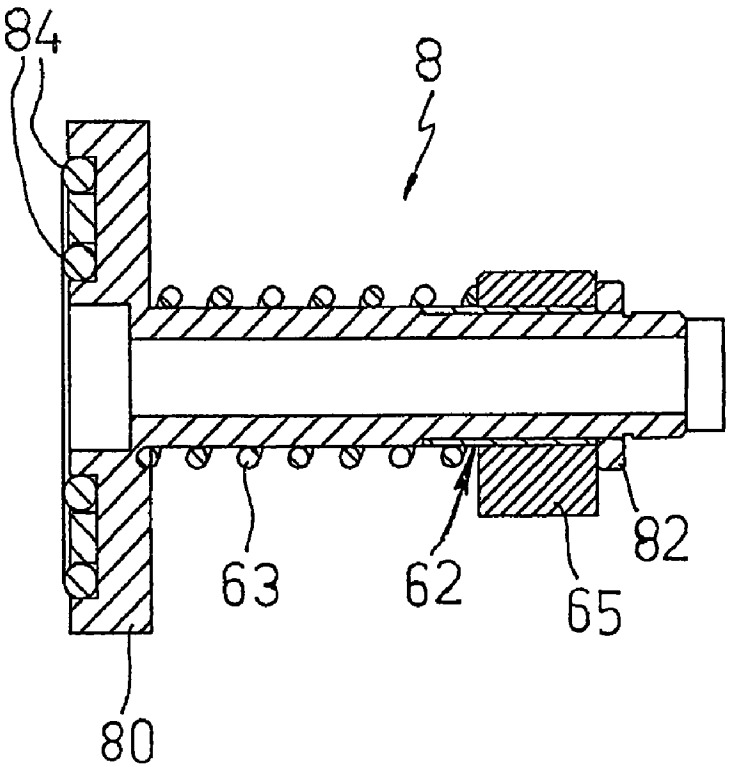
FIG. 5 is an enlarged detail of FIG. 1.
Figure 6:
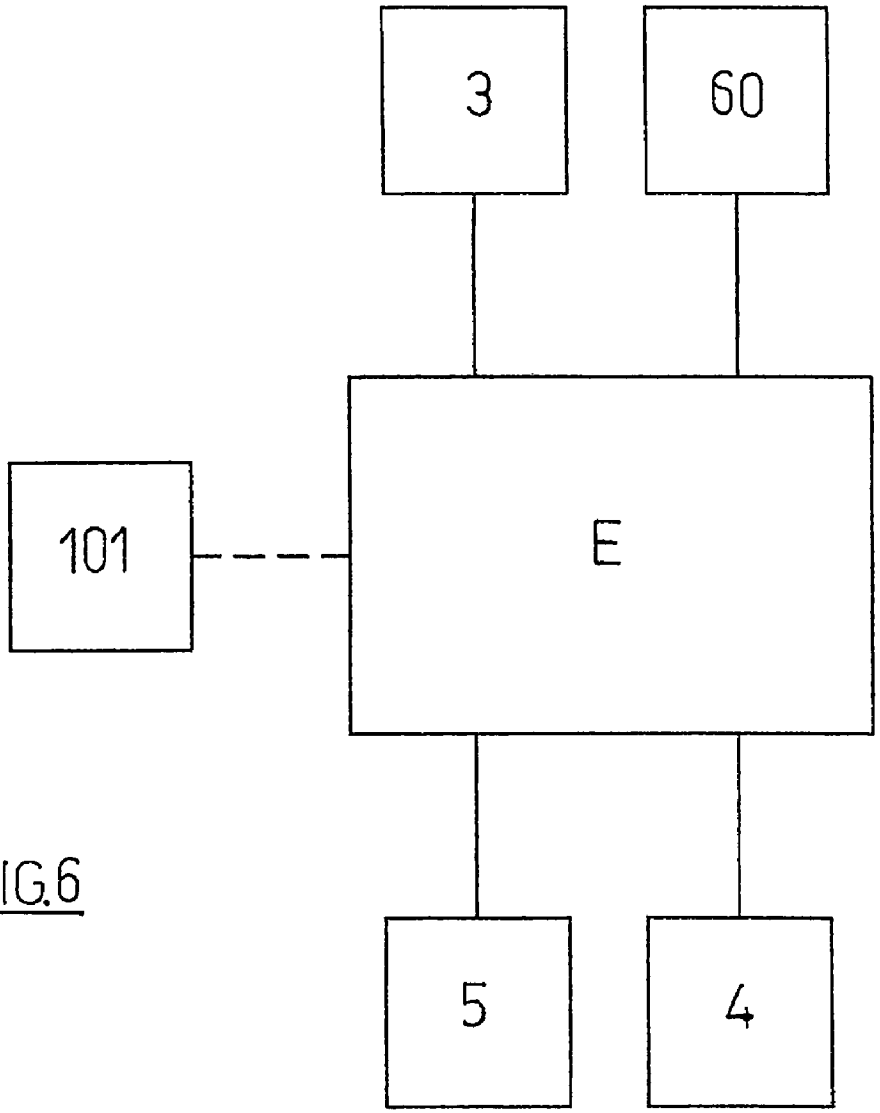
FIG. 6 is a simplified block diagram of the control system.

Thereafter, another cliché-jacket is fitted onto the cylinder, the on-off valve 60 being still in the on state. Finally, the valve 60 is switched off, the support 12 is remounted and the actuator 5 is deactivated. Then, the motor 4, by rotating in opposite direction with respect to the previous one, determines the axial movement, i.e. translation, of the cylinder 1 towards the operator side, until the normal operative position of the cylinder is reached. With reference to FIGS. 3 and 4 of the appended drawings (where the same elements shown in FIGS. 1 and 2 are denoted by the same reference numerals), the delivery means 8 is connected, by means of a corresponding bracket 100, to a linear actuator 101, the latter being solid to the frame 9. Said linear actuator drives the translation of said delivery means from and to the cylinder 1, so that the approach of the delivery means to the air inlet 7 of the cylinder 1 (as shown in FIG. 4) is obtained by simply moving the delivery means forwards (left-side direction in the figure). When the cliché-jacket is to be substituted, the same procedure described above is performed, with the exception that the contact between the air inlet 7 of the cylinder 1 and the delivery means 8 is obtained by translating the delivery means 8 forwards (the translation direction being parallel to the rotational axis of the cylinder 1) instead of translating the cylinder 1 backwards. The compressed air flow is activated, through the valve 60, with a preset late after having activated the actuator 101 or, by providing a limit switch (for sake of clarity not shown in the drawings) in a preset point along the path followed by the delivery means 8, when the limit switch senses that the delivery means 8 reaches a position in which there is the contact between the air inlet 7 and the delivery means 8.

A method according to the present invention comprises the following steps: sensing the position of said air inlet 7 relative to a delivery means connected to a compressed air supply 6; positioning said air inlet 7 in correspondence of said delivery means 8, that is, in a position where the air inlet 7 and the delivery means 8 are coupled, by means of controlled rotation of the cylinder 1 about its longitudinal axis and reciprocal approaching of the air inlet 7 and the delivery means 8; supplying compressed air through said delivery means 8 when it is coupled to said air inlet 7; extracting the cliché-jacket 2 from the cylinder 1 when the cliché-jacket is expanded by the compressed air flowing through said delivery means 8 and through a plurality of radial holes which are provided by the cylinder 1 and are connected with said air inlet 7.

From the above it is evident that any risk for the operator and for the machine is drastically reduced. At the same time, since the positioning described above is automatic, the time required to substitute a cliché-jacket are drastically reduced.

The elements driving the movements, command and control of the components described above are known to the technicians of the industrial automation and, therefore, they are not described in further detail. It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

The invention claimed is:

1. A device for the substitution of a cliché-jacket from a cliché cylinder in a printing machine or the like wherein said cylinder is connected to a motor driving said cylinder into rotation about a longitudinal axis thereof and said cylinder is provided with radial holes connected with an air inlet, said air inlet being apt to be connected with a compressed air supply by means of a delivery means, the device comprising:

an automatic means for sensing the position of said air inlet relative to said delivery means and automatic means for positioning said air inlet and said delivery means in a reciprocal coupling position, said automatic sensing and positioning means being connected to a programmable electronic unit which, when said air inlet and said delivery means are coaxial, drives said coupling and switches on an on-off valve which, on a side, is connected to said compressed air supply (6) and, on another side, is connected to said delivery means.

2. A device according to claim 1, wherein said delivery means is in a fixed and preset position.

3. A device according to claim 1, wherein said automatic means for positioning the air inlet of the cylinder in a coupling position with said delivery means comprises a means for axially translating said cylinder.

4. A device according to claim 3, wherein said means for moving said cylinder comprises a motor acting on a sleeve linked to the cylinder.

5. A device according to claim 1, wherein said delivery means comprises a tubular body having a disc-shaped distal end which is orthogonal to the longitudinal axis of the tubular body.

6. A device according to claim 5, wherein the external side of said disc-shaped end is provided with one or more sealing rings, said external side facing said cylinder.

7. A device according to claim 5, further comprising an elastic means for exerting on said tubular body a force directed towards the cylinder.

8. A device according to claim 1, wherein said on-off valve is positioned and acts along a duct connected to said compressed air supply.

9. A device according to claim 1, wherein said delivery means is connected to corresponding moving means.

10. A method for substituting the cliché-jacket on a cliché cylinder in a printing machine or the like wherein said cylinder is motorized so that said cylinder is driven into rotation about a longitudinal axis thereof and said cylinder is provided with a compressed air inlet which is connectable to a compressed air supply and said compressed air inlet is connected to a plurality of radial holes going through the cylinder and usable to obtain a deformation of the cliché-jacket fitted onto the cylinder, the method comprising the following automatic steps:

providing a delivery means;

providing a device comprising an automatic means for sensing a position of said air inlet relative to said delivery means and an automatic means for positioning said air inlet and said delivery means in a reciprocal coupling position, said automatic sensing means and said automatic positioning means being connected to a programmable electronic unit, said programmable electronic unit driving the coupling of said air inlet and said delivery means and said programmable electronic switching on an on-off valve when said air inlet and said delivery means are coaxial, said on-off valve being connected on one side to said compressed air supply, said on-off valve being connected to said delivery means on another side;

sensing the position of said air inlet with respect to said delivery means connected to said compressed air supply with said automatic sensing means;

positioning said air inlet in correspondence of said delivery means;

coupling said air inlet with said delivery means; and supplying compressed air through said delivery means.

11. A method according to claim 10, wherein said delivery means is in a fixed and preset position, wherein said positioning of the air inlet relative to the delivery means is obtained by rotating the cylinder about said longitudinal axis and approaching the cylinder to the delivery means through an axial translation of the cylinder.

12. A method according to claim 11, further comprising sensing the axial position of the cylinder before supplying the compressed air.

13. A method according to claim 10, wherein said positioning of the air inlet relative to the delivery means is obtained by rotating the cylinder about said longitudinal axis and approaching the delivery means to the cylinder through an axial translation of the delivery means.

14. A device for the substitution of a cliché-jacket from a cliché cylinder in a printing machine, the device comprising:

a motor;

a cylinder connected to said motor, said motor driving said cylinder into rotation about a longitudinal axis thereof, said cylinder comprising radial holes and an air inlet, said radial holes being in communication with said air inlet;

a compressed air supply;

a delivery means for delivering compressed air from said compressed air supply to said air inlet;

an automatic sensing means for sensing a position of said air inlet relative to said delivery means;

an automatic positioning means for positioning said air inlet and said delivery means;

an on-off valve, one side of said on-off valve being connected to said compressed air supply, another side of said on-off valve being connected to said delivery means;

a programmable electronic unit connected to said automatic sensing means and said automatic positioning means, said programmable electronic unit controlling said automatic positioning means such that said air inlet is coupled with said delivery means when said automatic sensing means senses said air inlet is coaxial with said delivery means, said programmable electronic unit switching on said on-off valve when said air inlet is coupled with said delivery means.

* * * * *